US009062531B2

(12) United States Patent
Jones

(10) Patent No.: US 9,062,531 B2
(45) Date of Patent: Jun. 23, 2015

(54) SYSTEM AND METHOD FOR MEASURING BOREHOLE CONDITIONS, IN PARTICULAR, VERIFICATION OF A FINAL BOREHOLE DIAMETER

(75) Inventor: David B. Jones, Houston, TX (US)

(73) Assignee: Tool Joint Products, LLC, Houston, TX (US)

( * ) Notice: Subject to any disclaimer, the term of this patent is extended or adjusted under 35 U.S.C. 154(b) by 56 days.

(21) Appl. No.: 13/047,436

(22) Filed: Mar. 14, 2011

(65) Prior Publication Data

US 2011/0226531 A1 Sep. 22, 2011

Related U.S. Application Data

(60) Provisional application No. 61/314,379, filed on Mar. 16, 2010.

(51) Int. Cl.
*E21B 47/08* (2012.01)

(52) U.S. Cl.
CPC ..... *E21B 47/082* (2013.01)

(58) Field of Classification Search
CPC ..... E21B 7/082
USPC ..... 175/40, 50, 57; 166/250.01; 73/152.02; 367/35
See application file for complete search history.

(56) References Cited

U.S. PATENT DOCUMENTS

| | | | | |
|---|---|---|---|---|
| 4,665,511 | A | 5/1987 | Rodney et al. | |
| 5,130,950 | A | 7/1992 | Orban et al. | |
| 5,200,705 | A | 4/1993 | Clark et al. | |
| 5,341,345 | A * | 8/1994 | Warner et al. | 367/99 |
| RE34,975 | E | 6/1995 | Orban et al. | |
| 5,469,736 | A | 11/1995 | Moake | |
| 6,880,647 | B2 * | 4/2005 | Villareal | 175/40 |
| 7,168,507 | B2 | 1/2007 | Downton | |
| 7,389,828 | B2 | 6/2008 | Ritter et al. | |
| 7,434,631 | B2 | 10/2008 | Krueger | |
| 7,513,147 | B2 | 4/2009 | Yogeswaren | |
| 8,130,591 | B2 * | 3/2012 | Geerits | 367/35 |

(Continued)

FOREIGN PATENT DOCUMENTS

GB 2460096 11/2009

OTHER PUBLICATIONS

Addis, Tony, et al "The Quest for Borehole Stability in the Cusiana Field" OilField Review, Apr./Jul. 1993, pp. 33-43.

(Continued)

*Primary Examiner* — Nicole Coy
(74) *Attorney, Agent, or Firm* — Andrew W. Chu; Craft Chu PLLC

(57) ABSTRACT

The present invention is a system and method for measuring borehole conditions, in particular for verification of a final diameter of a borehole. The system includes a drill string with a drill bit and a drilling mud circulation device, an underreamer attached to the drill string above the drill bit, and a tool body attached to the drill string, having a sensor for detecting downhole conditions, such as borehole diameter. The tool body is mounted above the underreamer and has a diameter smaller than the underreamer and drill bit. The sensor can be an ultrasonic transducer with adjustable signal amplitude and can be fixed in positions along the tool body. The system may also include a calibrator for sensor data, and an auxiliary tool body with another sensor between the drill bit and the underreamer. The method of the present invention is use of the system for final borehole verification.

19 Claims, 7 Drawing Sheets

(56) References Cited

U.S. PATENT DOCUMENTS

| | | | | |
|---|---|---|---|---|
| 2008/0110253 | A1 | 5/2008 | Stephenson | |
| 2008/0128175 | A1 | 6/2008 | Radford et al. | |
| 2008/0186805 | A1* | 8/2008 | Han | 367/35 |
| 2011/0278064 | A1* | 11/2011 | Rasheed | 175/24 |

OTHER PUBLICATIONS

Market, Jennifer et al. "Reliable LWD Caliper Measurements" SPE (Society of Petroleum Engineers Offshore Europe Oil and Gas Conference and Exhibition, Aberdeen, UK, Sep. 6-8, 2011, pp. 1-13.

Peternell, Ana et al. "Deepwater Wells Top Hole Cement Volume Evaluation using Innovative Hole Size Inversion from LWD Propagation Resistivity Measurements" SPE (Society of Petroleum Engineers Annual Technical Conference and Exhibition, New Orleans, USA, Sep. 30, 2013-Oct. 2, 2013, pp. 1-15.

White, I. et al "Extracting Caliper Data from LWD Propagation Resistivity Measurements: A Unique Methodology to Optimize Real Time Understanding of Borehole Condition" SPWLA (Society of Petrophysicist and Well Log Analysts) 53rd Annual Logging Symposium, Caragena, CO, Jun. 16-20, 2012, pp. 1-13.

* cited by examiner

SYSTEM AND METHOD FOR MEASURING BOREHOLE CONDITIONS, IN PARTICULAR, VERIFICATION OF A FINAL BOREHOLE DIAMETER

RELATED U.S. APPLICATIONS

The present application claims priority under U.S. Code Section 119(e) from a provisional patent application, U.S. Patent Application No. 61/314,379, filed on 16 Mar. 2010 and entitled "SYSTEM AND METHOD FOR FINAL BOREHOLE VERIFICATION".

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to measuring features and conditions of boreholes of wellbores in the oil and gas industry. More particularly, the present invention relates to a system for taking measurement of a diameter of the borehole after drilling and underreaming the borehole. The present invention also relates to a system for taking measurement of a diameter of the borehole simultaneous with drilling and underreaming the borehole. Additionally, the present invention relates to a method of verifying the diameter of a borehole during and after drilling and underreaming.

2. Description of Related Art Including Information Disclosed Under 37 CFR 1.97 and 37 CFR 1.98.

Drilling is part of a process for extracting a natural resource, such as ground water, natural gas, and petroleum, or for exploring the nature of the material underground. A well or borehole can be created by use of a drilling rig to rotate a drill string, which has a drill bit attached at its end in order to bore into the ground to a desired depth. Drill collars and drill pipe sections add length, weight and support along the drill string as the borehole deepens, and different types of drill bits cut into all types of rock formations and soil combinations. Drilling fluid or drilling mud pumps through the inside of the string, out of the drill bit by nozzles or jets, and up the annulus to the surface, in order to create the proper physical and hydrostatic conditions to safely drill the well. Additionally, the rock cuttings are removed from the borehole in the drilling mud circulation flowing to the surface.

After drilling a section of hole, steel casings, which are slightly smaller in diameter than the borehole diameter, are placed in the hole. Cement can be injected in the annular space between the outside of the casings and the borehole. The casing system strengthens the integrity of the new section of the borehole to allow for deeper drilling and other benefits. A series of smaller and smaller drill bits with corresponding smaller steel casing systems are used for drilling, such that a completed well includes holes within holes. In the prior art technology, the diameter of the borehole decreases as each section of the casing systems are put in place.

However, the latest developments in drilling require deeper and deeper wells, even super deep wells from holes five to six miles below the surface. The continuing reliance upon fossil fuels, in particular oil and gas, has pushed the drilling and exploration industry to explore ultra deep waters (water depths more than 2000 m) with super deep wells drilled to depths over more than 7500 m. The temperature, distance, and pressure conditions of super deep wells require a vast amount of resources to extract oil and gas. The newly extreme depths cannot be reached with the prior art technology because the decreasing size of the diameter of the borehole set a limit on the depth of drilling.

The industry response to form super deep boreholes has been reaming or under-reaming, which enlarges the diameter of the borehole by removing a layer of the already stressed and disturbed material caused by the drill bit. Reaming has been known in metalworking and machining to affect mechanical properties for a good surface finish. Applied in the field of wellbore drilling, an underreamer is an activated cutting tool on the drill string to enlarge the borehole. The typical underreamer has a set of retractable and extendible parallel straight or helical cutting edges along the length of a cylindrical body and is placed higher than the drill bit along the drill string. The cutting edges have an angle and with a slight undercut below the cutting edges for making initial contact with the sides of the borehole.

The adaptation of underreamers has lead to even greater challenges in the oil and gas industry. Controlling the drill bit and the drill string in the borehole has always required special attention. Measurement While Drilling (MWD) and Logging While Drilling (LWD) systems collect real-time data, which is data viewed while drilling, and memory stored data, which is data viewed after the bit run. The data helps to ensure the proper direction and conditions of the drilling and record formation properties. MWD systems measure and record readings, such as natural gamma ray, borehole pressure, temperature, resistivity, formation density, etc., and the data can be transmitted as fast as real-time via mud pulser telemetry, wired drill pipe or other means. Stabilizers added on the drill string are mechanical solutions to reduce drill string vibrations, improve directional hole accuracy, and improve drilling efficiency. At the newly extreme distances and depths achieved with reamers, it becomes even more important for accurate monitoring because of the costs and resources invested, and it has become even more challenging with the underreamer positioned in the drill string. The underreamer is a separate cutting tool, so the drilling diameter of the drill bit and the larger final diameter, after the underreamer, are different. The prior art does not provide for the final confirmation of borehole diameter, after the underreamer and while drilling.

For measuring the borehole diameter, the present typical system is a wireline mechanical caliper tool, which collects a caliper log of the tracked measurements of the size and shape of a borehole, after drilling the hole section has been completed and after the drill string and drill bit have been removed from the well. The borehole diameter is an extremely vital piece of information for super deep wells because the borehole must be a particular size in order to fit the proper casing system. The extreme depths required cannot be achieved, if the boreholes become too small for the casings. The extending stacking of the casings cannot be supported or selected correctly if the borehole dimensions are too small. The wireline mechanical caliper tool verifies the borehole diameter as it is opened and withdrawn from the bottom of the hole; two or more articulated arms push against the walls of the borehole, taking hole diameter measurements. This prior art wireline mechanical caliper tool requires complete stoppage of the drilling operation and withdrawal of all drilling equipment from the borehole. As such, the wireline mechanical caliper tool and the method of using the caliper tool are very significant in terms of rig time and efficiency for the well.

In the past, various patents have been issued in the field of borehole diameter measurement. For example, U.S. Pat. No. 7,168,507, issued to Downton on Jan. 30, 2007, and published as 20030209365, discloses an invention to recalibrate downhole sensors. A first set of inexpensive and small sensors are located in the drill string adjacent to the bit, and a second set of more accurate sensors is located in a more protected location higher in the drill string away from the drill bit. As drilling progresses, the second set collects data to calibrate an offset of the first set of sensors. The invention discloses the placements of sensors away from the drill bit for better accuracy to measure for gas influx into the borehole.

U.S. Pat. No. 5,200,705, issued to Clark, et al. on Apr. 6, 1993, teaches a system for determining a dip characteristic of formations surrounding a borehole and a method of using a transducer array having longitudinally spaced transducers. The electrodes are located on the stabilizer blades to detect electric current from the coil antennas on a drill collar above the stabilizers. The electrodes on the stabilizer blades function as a sensor for electric current.

U.S. Pat. No. 5,130,950, issued to Orban, et al. on Jul. 14, 1992, describes an ultrasonic measurement apparatus. This patent is one of several similar patents relating to measuring characteristics in boreholes. The '950 patent clearly discloses the placement of a sensor in a stabilizer, even though no reamer is shown. FIG. 1 shows a stabilizer 27 with a sensor 45. This prior art only measures the pilot hole.

United States Patent Application Publication No. 20080110253, published by Stephenson, et al. on May 15, 2008, discloses an invention for downhole measurement of substances in formations while drilling. The method includes waiting for substance that is dissolved in the drilling fluid to be in equilibrium with any of the substance in the earth formation cuttings and measuring the substance dissolved in the drilling fluid downhole. FIG. 1 shows a sensor 99 placed away from the drill bit 15 and above the stabilizer 140.

U.S. Pat. No. 7,434,631, issued to Krueger, et al. on Oct. 14, 2008, teaches an apparatus and method of controlling motion and vibration of an NMR sensor in a drilling BHA. The sensor is disposed in the drilling assembly for making a measurement of a formation parameter of interest. A non-rotating stabilizer is disposed in the drilling assembly proximate the sensor. The non-rotating stabilizer is adapted to reduce motion of the sensor below a predetermined level during the measurement. This invention embodies the prior art with the sensor locked in a single non-rotating position on the drill string, so the errors in readings occur.

UK Patent Application, GB 2460096, published on Nov. 18, 2009, by Wajid, discloses an underreamer and caliper tool having means for determining bore diameter. In this publication, the tool integrates the enlargement of the borehole and measurement of the borehole diameter. The tool body attaches to the drill string and has expansion elements housing the caliper. The expansion elements are the cutting tool after the drill bit, and sensors measure borehole diameter during or after the underreaming. The specialized expansion elements with real-time data allow for control of the underreaming process.

At present, there is no LWD (Logging While Drilling) equipment available, that is dedicated to measurement during drilling and underreaming, i.e. MWD (Measurement While Drilling) systems, to determine the final well-bore diameter of any hole section that has been drilled. Many companies claim to be able to provide 'Real Time Well-Bore Diameter Measurements', but in reality, such data is apparently an 'inferred' reading, or a 'pseudo' caliper reading, such that the accuracy is questionable. The problem seems to be associated with a number of factors: the changing composition of the drilling mud affects the reading, the borehole is irregularly shaped, and the position of the bottom hole assembly and the sensors are not usually equidistant to the borehole wall, such that the reading depends upon the position of the sensor.

It is an object of the present invention to provide a system and method for measuring features and conditions of a borehole. Diameter of a borehole is one such condition of the borehole to be measured by the present invention. Other features and conditions of MWD tools may be adapted into the system and method of the present invention.

It is an object of the present invention to provide a system and method for verification of a borehole. In particular, the system measures the "final" diameter of a borehole, which is a borehole after drilling and after underreaming.

It is an object of the present invention to provide a system and method for verification of a borehole during drilling and underreaming in real time. In particular, the system measures the real time "final" diameter of a borehole, which is a borehole during drilling and underreaming.

It is another object of the present invention to eliminate the need for separate caliper measurements of the final borehole.

It is still another object of the present invention to provide a system and method for verification of a final borehole compatible with existing technology.

It is an object of the present invention to provide a system and method for verification of a final borehole for any drilling and/or expansion operation of a wellbore.

It is another object of the present invention to provide a system and method for verification of a borehole with calibration means. In particular, the calibration means includes both a downhole and surface system for calibration of the sensor readings.

It is a further object of the present invention to provide a system and method for verification of a borehole before and after underreaming.

It is an object of the present invention to provide a system and method for verification of a borehole with improved accuracy of final borehole measurements.

It is another object of the present invention to provide a system and method for verification of a borehole to monitor the efficiency of the underreamer.

It is another object of the present invention to provide a system and method for verification of a borehole, which stabilizes the drill string while measuring the final borehole diameter.

It is still another object of the present invention to provide a system and method for verification of a final borehole in a cost effective and efficient manner.

These and other objects and advantages of the present invention will become apparent from a reading of the attached specification and appended claims.

SUMMARY OF THE INVENTION

The present invention is a system and method for measuring conditions of a borehole, in particular for verifying a final diameter of a section of a borehole. The system of the present invention comprises a drill string, an underreaming means, and a tool body with a sensor. The drill string has a bottom hole assembly with a drill bit at a terminal end thereof and a circulation means for the drilling mud. The underreaming means or underreamer is attached to the drill string above the drill bit and has a passage for flow of the drilling mud. There are cutting edges on the underreaming means so as to enlarge a diameter of the borehole after being drilled by the drill bit of the bottom hole assembly. The tool body also attaches to the drill string, and the sensor detects the downhole conditions, such as the diameter of the borehole. The tool body is mounted above the underreaming means and has a diameter smaller than the underreaming means. The tool body is rotatably and axially aligned with the drill string, so that flow of the drilling mud is within the drill string, through the inside of the tool body, and then outside of an outer shell body of the tool body and up to the surface. The tool body can also have a plurality of stabilizer blades for drill string stabilization.

The sensor means can be comprised of an ultrasonic transducer with adjustable signal amplitude so as to measure diameter of the borehole. The sensor means has at least one fixed position, the fixed position being located on the outer shell body or on the stabilizer blades. The tool body has regular components for the communication and storage of the sensor data and communicates or connects to the sensor means. Additionally, there is a means for communicating information from the downhole location to a surface location. Any known transmission method, such as downhole to surface telemetry sub, mud pulsar or wireless connection link to third party pulsar, or wired pipe, can be used.

The system of the present invention may also include a means for calibrating the sensor on the tool body. When the circulation means for the drilling mud reaches the surface location, there is a return mud flow line. The means for calibrating interacts with this return mud flow line or with the mud through the drill string. The calibrating means for the sensor is comprised of transducers on an interior of the tool body in fluid connection to the circulation system of the drilling mud through the drill string and/or on a surface location in fluid connection with the circulation system of the drilling mud. A first ultrasonic transducer on the interior can be in the passage of mud flow inside or outside of the tool body, and a second ultrasonic transducer on the surface can be in the mud flow line at the surface location. A processor for comparing data from the first and second transducers allows adjustment of the sensor readings for more accurate data and therefore improved drilling efficiency. In particular, the first ultrasonic transducer is positioned in the passage for flow with a fixed gap spacing slot with a known diameter, transmitting a reading across the known diameter during drilling so as to record ultrasonic travel time across the known diameter. If the travel time for a known distance through the mud flow changes, then the sensor reading to the borehole wall should be similarly calibrated according to this change. The second ultrasonic transducer can be a surface calibration block with known dimensions in the return mud flow line, transmitting a signal reading across the calibration block, comparing properties of the drilling mud at the surface location and at the tool body. Similar to the first ultrasonic transducer, the calibration block has a gate with a fixed distance. The travel time for this fixed distance is monitored through the return mud flow. If the travel time for the fixed distance through the mud flow changes, then the sensor reading to the borehole wall should be similarly calibrated according to this change. The second ultrasonic transducer can be a back-up calibration means and requires time adjustment for the readings and the timing of the mud flow downhole and the return mud flow at the surface. The transducers for the sensor can be similar to the transducers for the calibrator.

The system of the present invention may also include an auxiliary tool body attached to the drill string. The auxiliary tool body has an auxiliary sensor means for detecting downhole conditions, which functions analogous to the sensor means on the tool body. The auxiliary tool body is mounted between the underreaming means and the bottom hole assembly with the drill bit, such that the readings of the auxiliary sensor are from a different downhole location than the sensor means of the tool body. The auxiliary sensor can also be correspondingly adjusted by the calibrating means in a similar manner.

The method for verification of a borehole, in particular for measuring a final diameter of a borehole, corresponds to using the system of the present invention. First, a pilot borehole is drilled using a drill string having a bottom hole assembly with a drill bit at a terminal end thereof and a circulation system for drilling mud. Next, a reamed borehole is drilled using an underreamer attached to the same drill string above the drill bit. The underreamer has cutting edges so as to enlarge a diameter of the pilot borehole to the reamed borehole. Finally, the diameter of the reamed borehole is measured by the sensor on the tool body of the present invention, above the underreamer. The method includes the use of the sensor on the tool body or on stabilizer blades on the tool body.

Communicating real-time information from a downhole location to surface location is another step in the method of the present invention. The step uses known technology, such as a downhole to surface telemetry sub, mud pulsar or wireless connection link to third party pulsar, or wired pipe. Another possible step of the method of the present invention is calibrating of the sensor, which takes the measurement of the reamed borehole. The step of calibrating involves adjustment by monitored drilling mud flow properties at a downhole location and/or at a surface location. Still another step of the method of the present invention is attaching an auxiliary tool body with an auxiliary sensor to the drill string. The auxiliary tool body and auxiliary sensor detect downhole conditions, such as hole diameter, between the underreamer and the bottom hole assembly with the drill bit. The calibrating and auxiliary sensor allow for real-time monitoring with increased accuracy and precision.

DETAILED DESCRIPTION OF THE DRAWINGS

Figure 1:
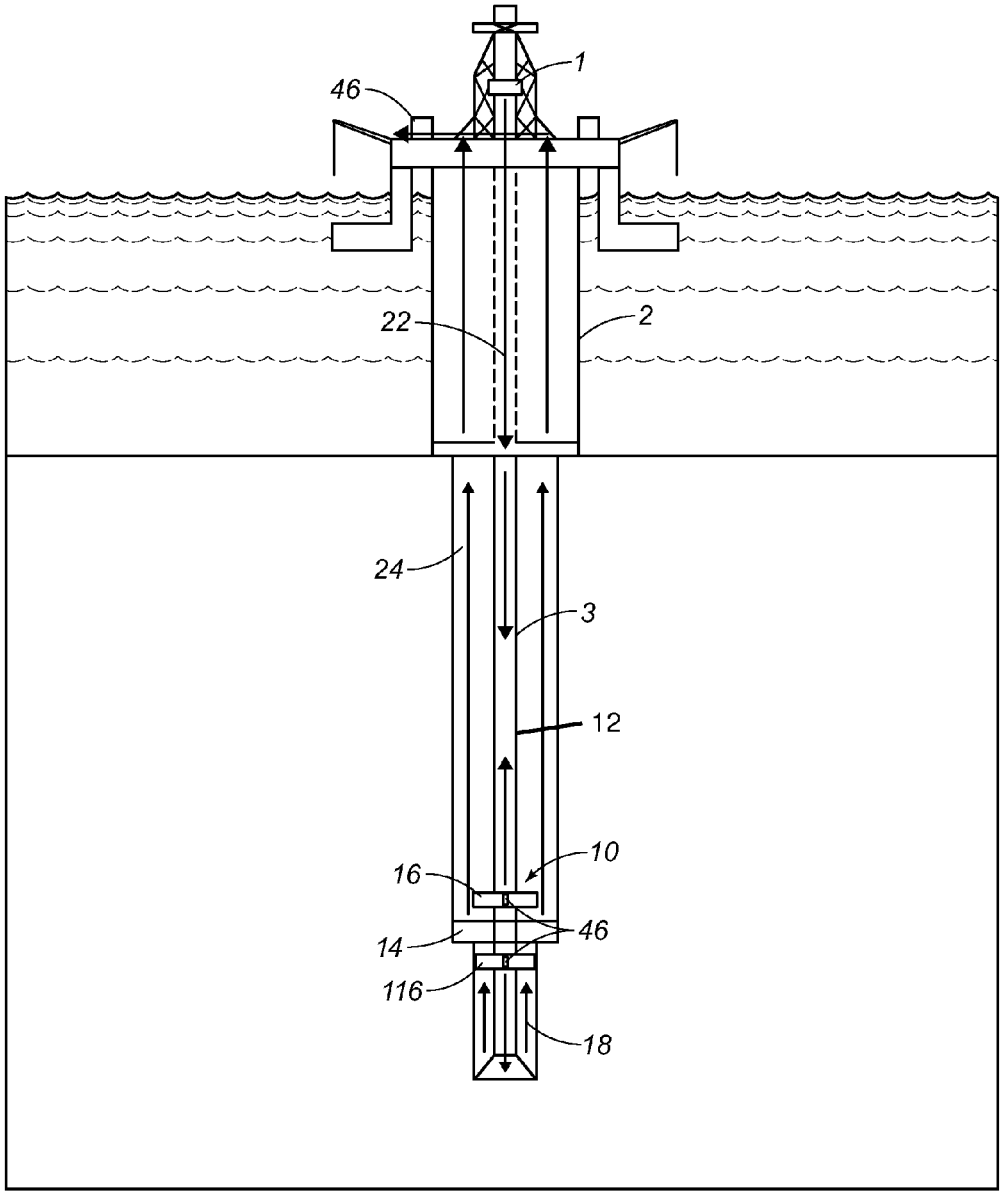
FIG. 1 is a schematic view of a deep water drilling rig, showing the system and method of the present invention.
Figure 2A:
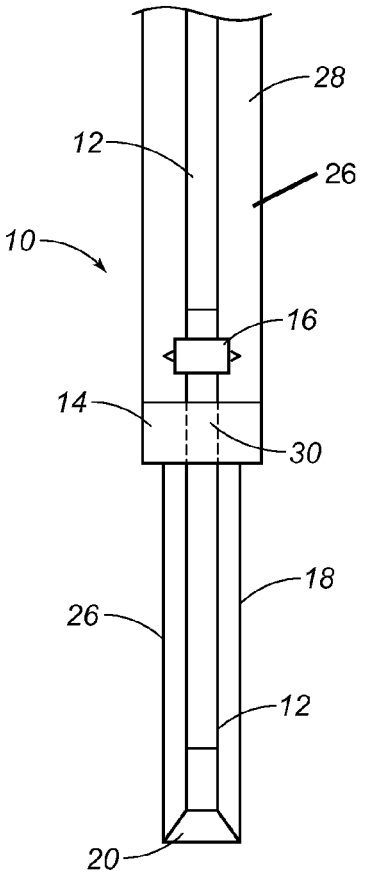
FIGS. 2A and 2B are schematic views of the downhole portion of the system, showing embodiments of the present invention without and with the auxiliary tool body, respectively.
Figure 2B:
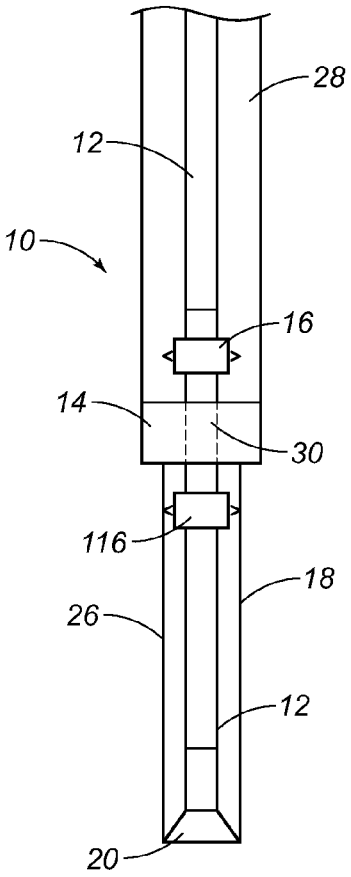

FIG. 1 shows a deep water drilling rig 1, marine riser 2 and hole section 3 for a typical subsea well. These structures are used in super deep drilling as well. The system 10 for measuring borehole conditions, such as verification of a borehole diameter, of the present invention is shown in the hole section 3. FIGS. 2A and 2B are exploded schematic views of the system 10 for measuring a final diameter of a borehole. The system 10 includes a drill string 12, an underreaming means 14, and a tool body 16. The drill string 12 has a bottom hole assembly 18 with a drill bit 20 at a terminal end thereof. The drill string 12 also includes a circulation means 22 for drilling mud 24. The underreaming means 14 attaches to the drill string 12 above the drill bit 20 so that the portions of the pilot borehole 26 are differentiated from the reamed borehole 28. The underreaming means 14 is compatible with the circulation means 22 and maintains a passage 30 for flow of the drilling mud 24 through the underreaming means 14. Importantly, the underreaming means 14 has activatable cutting edges 32 so as to enlarge a diameter of the pilot borehole 26 after being drilled by the drill bit 20 of the bottom hole assembly 18.

Figure 3:
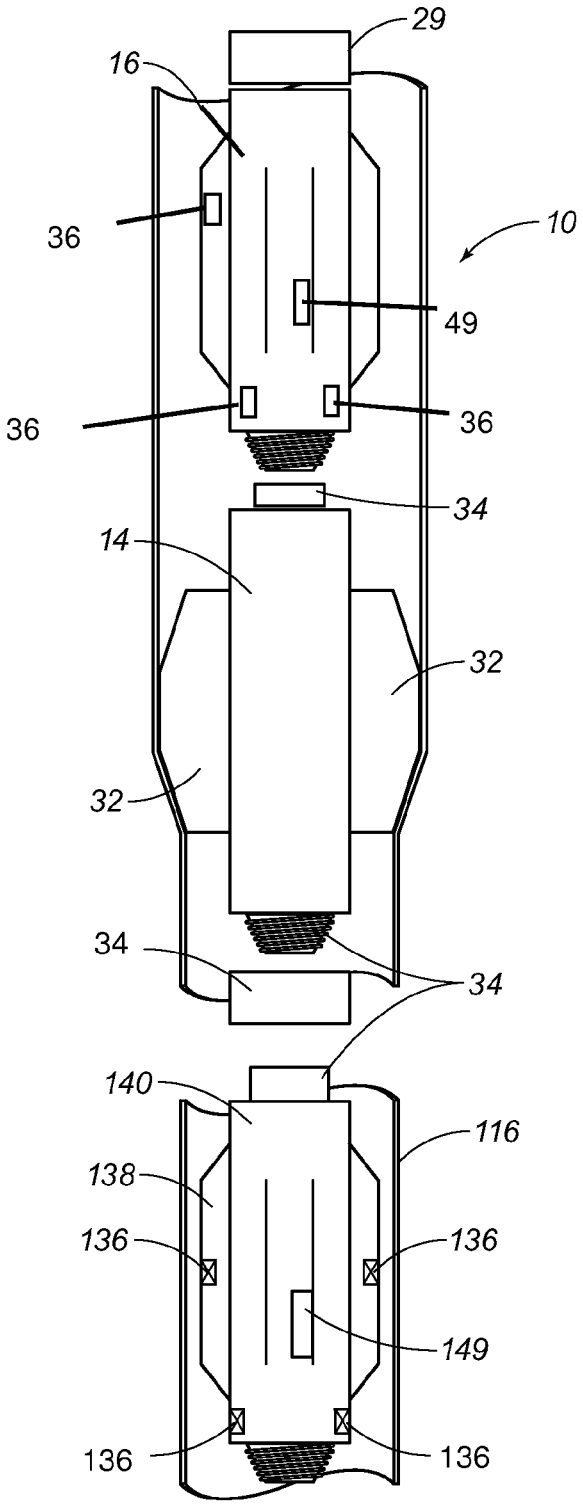
FIG. 3 is an exploded and schematic view of the tool body, underreaming means, and auxiliary tool body of the system and method of the present invention.

The tool body 16 has a means for attachment 34 to the drill string 12, as shown in FIG. 3, the exploded schematic view of the system 10 of the present invention. This attachment means 34 can be screwing engagement or pin thread or any acceptable device for any type of drill collar 29. FIG. 3 shows the tool body 16 mounted above the underreaming means 14. The diameter of the tool body 16 is smaller than the underreaming means 14 and the drill bit 20. In this manner, the tool body 16 can be a traditional stabilizer for a drill string 12, as it is rotatably and axially aligned with the drill string 12. Alternatively, the tool body 16 may fixedly engage a drill collar 29 of the drill string 12 as an attachment 34 to an existing part of the drill string 12. Furthermore, the tool body 16 can have a plurality of stabilizer blades 38, wherein a maximum diameter of the stabilizer blades 38 on the tool body 16 is still smaller than a diameter of the underreaming means 14 and the drill bit 20. These stabilizer blades 38 are non-cutting protrusions aligned with the drill string 12, which add stability to the drill string 12 and the bottom hole assembly 18 by reducing vibration and giving rigidity.

Figure 6:
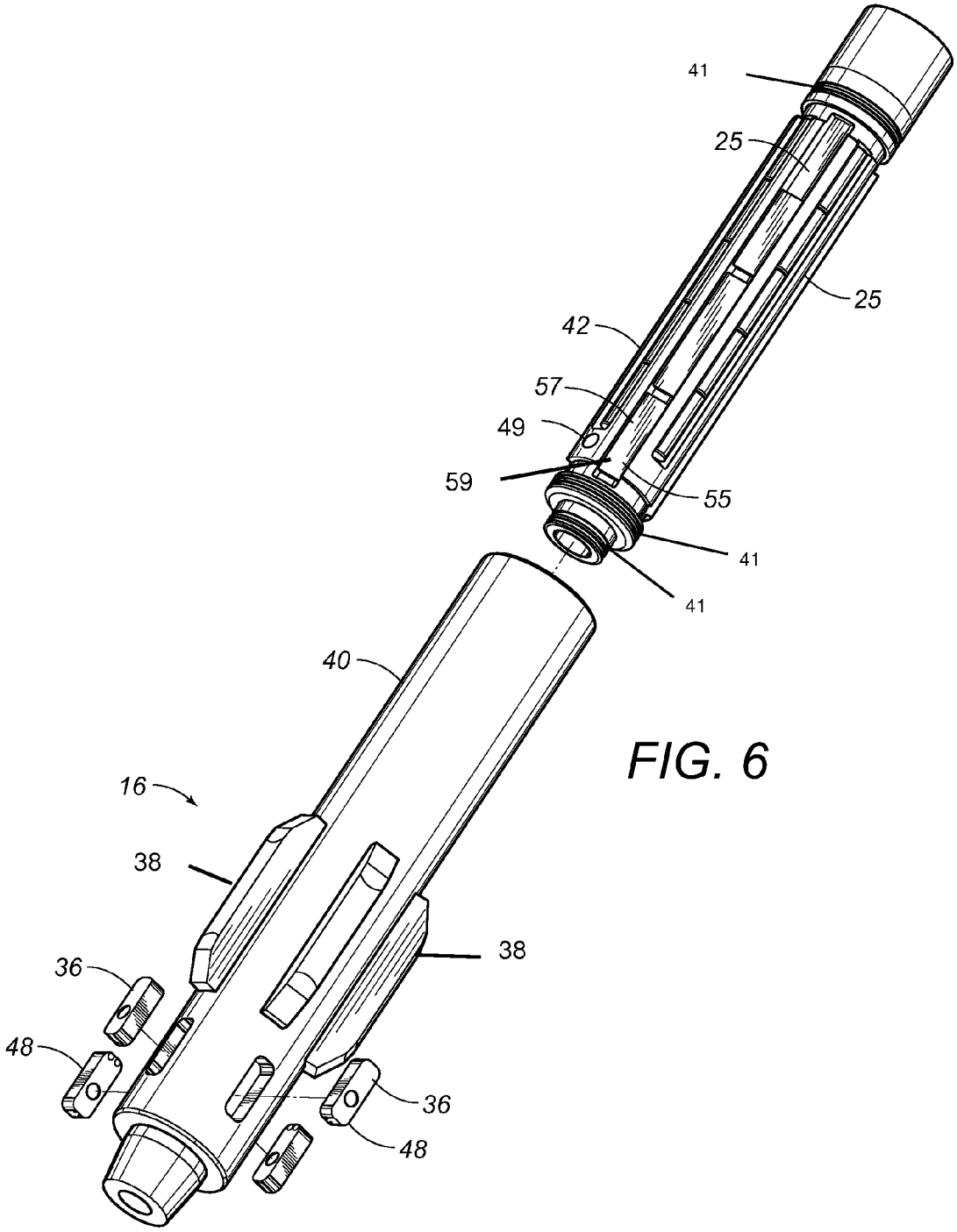
FIG. 6 is an exploded schematic perspective view of the tool body of the system and method of the present invention.
Figure 7:
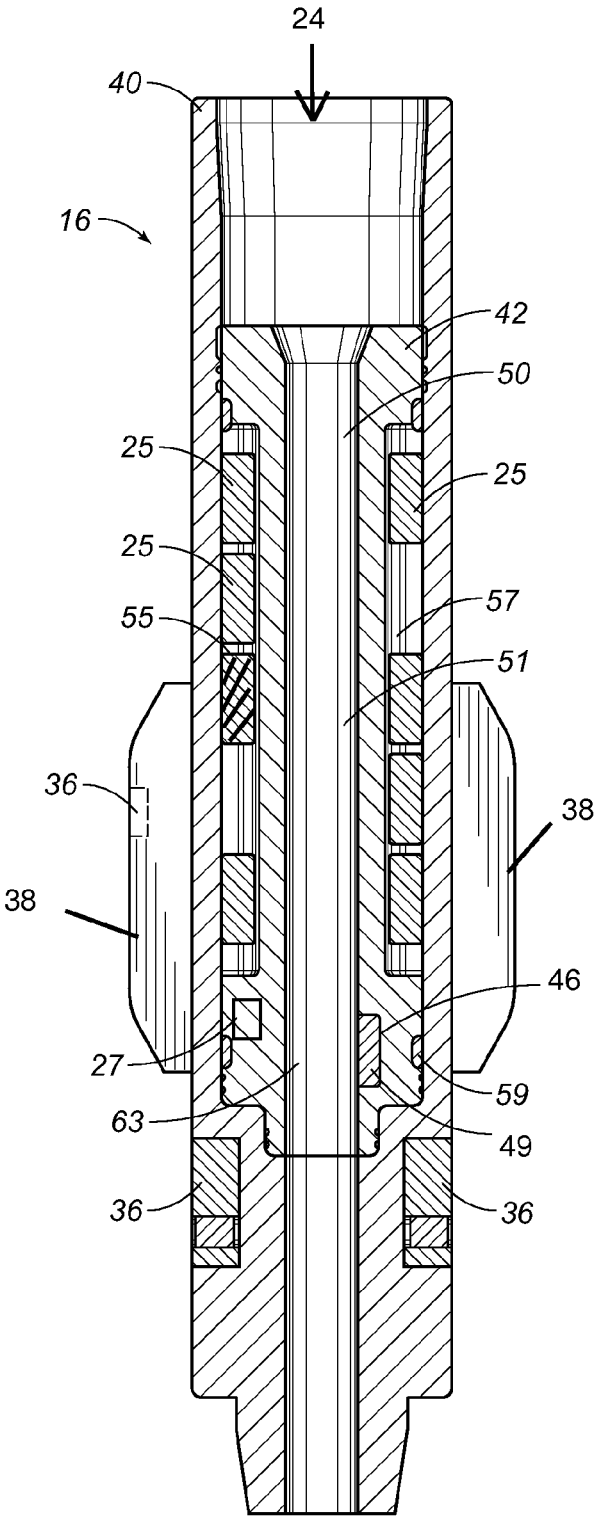
FIG. 7 is a longitudinal cross-sectional schematic view of the tool body of the system and method of the present invention.

FIGS. 6 and 7 show the tool body 16 having a sensor means 36 for detecting downhole conditions. The tool body 16 can be comprised of steel, forming an outer shell body 40 and an inner housing 42, wherein the inner housing 42 is an inner sleeve housing locked within the outer shell body 40. There are seals 41 at opposite ends of the inner housing 42 engaging the outer shell body 40. There are seals 41 above and below means for calibrating 49 on the inner housing 42. The drilling mud 24 can flow in the drill string 12, through a passage 50 through an interior 51 of the tool body 16 and then along an outside of the outer shell body 40 of the tool body 16.

Figure 4:
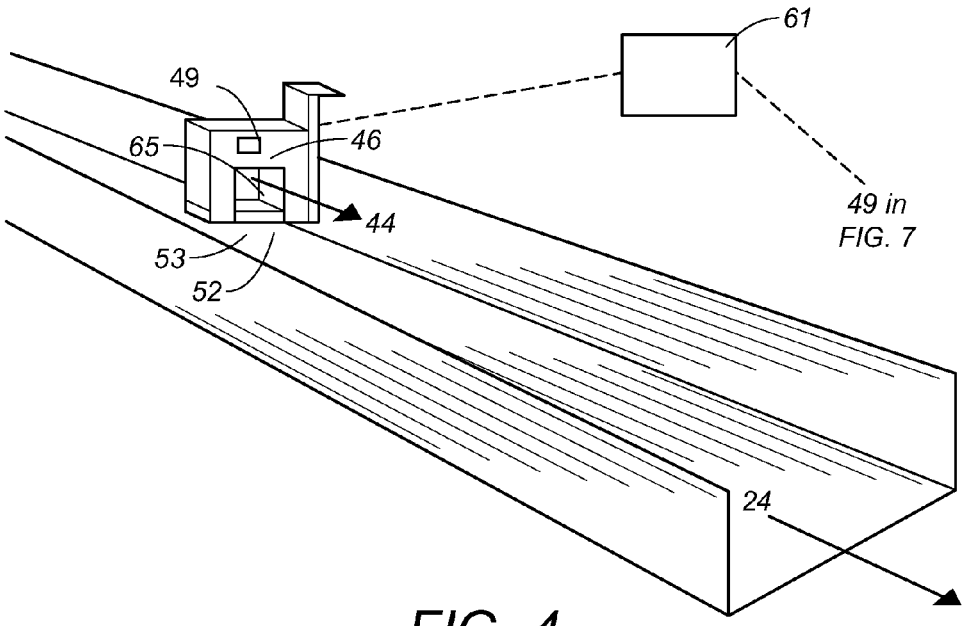
FIG. 4 is another schematic view of a portion of the calibrating means at the surface location.

Also in FIGS. 6 and 7, the tool body 16 with a sensor means 36 of the system 10 for measuring borehole conditions, including verification of a borehole, further comprises the necessary contents for collecting, storing, and transmitting data. Accordingly, the tool body 16 has an application programming interface 27 housed inside the inner housing 42. The sensor means 36 can be comprised of an ultrasonic transducer 48 with adjustable signal amplitude so as to measure diameter of the reamed borehole 28. The ultrasonic transducer 48 can be comprised of a piezo-electric material. The sensor means 36 has at least one fixed position, the fixed position being located on the outer shell body 40 or on the stabilizer blades 38. FIG. 7 illustrates the fixed position locations at each sensor means 36 downhole, and FIG. 4 shows the surface location 53. The downhole sensor means 36 of FIG. 7 connects to the inner housing 42 inside the outer shell body 40 by communication signals or hardware connections for transmitting sensor data to the system 10. FIG. 7 shows the sensor means 36 with a separate unit on a stabilizer blade 38. Any number of individual sensors can be placed on the tool body 16 as the sensor means 36 of the present invention. FIG. 6 shows a tip of the tool body 16 with a plurality of sensors 36 with a concentric arrangement 48. The sensor means 36 can be on the outer shell body 40 or on the stabilizer blade 38. The inner housing 42 connects to the sensor means 36, such that the inner housing 42 contains the power supply 25, circuitry 55, and memory storage components 57 in a pressurized environment. A power supply 25, such as a battery, fits inside the inner housing 42, the inner housing 42 being within the outer shell body 40 of the tool body 16. FIG. 6 shows the inner housing 42 with O-ring type seals friction-fit in the outer shell body 40, and the inner housing 42 and the outer shell body 40 are longitudinally aligned, such that drilling rotation and mud flow 24 through the drill string 12 are not encumbered.

Figure 5:
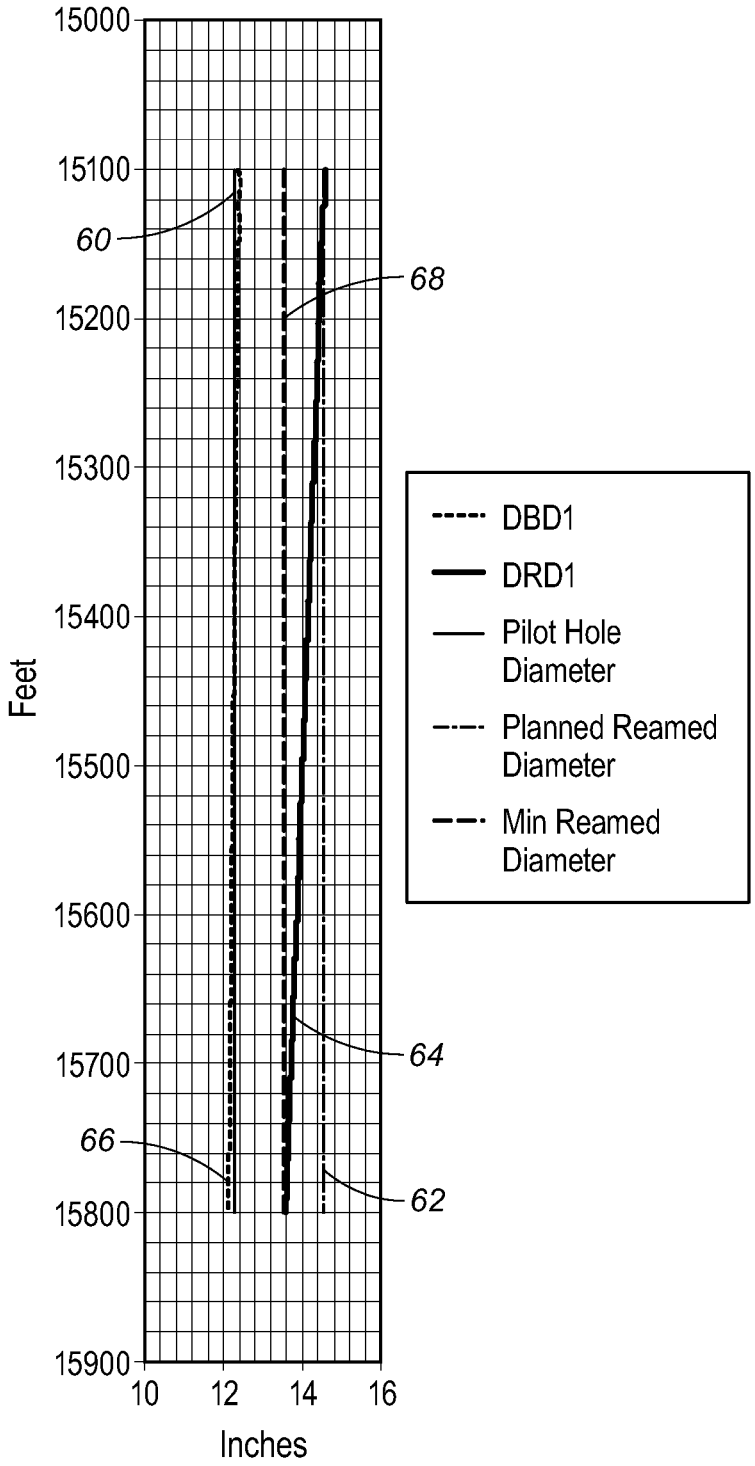
FIG. 5 is a graph illustration showing the real-time borehole diameter log of the data collected by the system and method of the present invention, in comparison with the planned pilot borehole, actual drill bit diameter, planned reamed hole and actual reamed diameter.

Additionally, a means for communicating information 59 from a downhole location to a surface location may be mounted in the inner housing 42 of the tool body 16. The means for communicating 59 can be any known downhole to surface telemetry sub, mud pulsar or wireless connection link to third party pulsar, or wired pipe. The communication enables real-time data to be presented for monitoring. In this manner, it will be possible to determine the efficiency of the underreaming without stopping drilling operations and without withdrawing the drill string 12 for a prior art mechanical wireline caliper measurement. The data can be presented as shown in FIG. 5, wherein the horizontal axis shows diameter and the vertical axis shows depth. The planned drill bit diameter 60 and the planned underreamer diameter 62 are supposed to be set, but they are subject to wear in such conditions, and underreamers are subject to malfunction so that they may not fully extend when activated. FIG. 5 shows how the system 10 and method of the present invention tracks the reamed borehole diameter 64 as the underreaming means 14 becomes worn or becomes retracted. The system 10 also tracks the drilled pilot hole diameter 66. The minimum hole size 68 required for successful operation, i.e. fitting a casing into the hole and cementing in place is also shown. As an example, if the borehole must measure a minimum of 13.5 inches to properly allow for casings to be placed correctly, then the present system 10 provides this accurate measurement and assurance. The prior art cannot provide the same accuracy while drilling and relies more upon an algorithmic solution for the pilot hole diameter and speculated reamed borehole diameter. The system 10 eliminates the risk of boreholes that are too narrow to allow continued drilling and further operations that require a certain borehole size, which are essential to reach super deep resources and to establish super deep production of oil and gas.

Another feature of the system 10 of the present invention is shown in FIGS. 1, 3, 4, 6, and 7. Because the drill string 12 includes a circulation means 22 for drilling mud 24, there is a mud flow line 44 at a surface location of the drilling rig 1 and downhole in FIG. 1. The system 10 interacts with this mud flow line 44 with a means 46 for calibrating the sensor means 36. The means for calibrating 46 is comprised of ultrasonic transducers 49 similar to the sensor means 36. These ultrasonic transducers 49 are placed in different locations from the transducers for the sensor means 36. FIG. 7 shows a first ultrasonic transducer 49 on an interior 51 of the tool body 16 in fluid connection to the circulation system 22 of the drilling mud 24 through the drill string 12. FIG. 6 shows a first ultrasonic transducer 49 on an exterior of the inner housing 42. FIG. 4 shows a second ultrasonic transducer 52 on a surface location 53 in fluid connection with the circulation system 22 of the drilling mud 24. The transducers of the sensor means 36 and the means for calibrating 46 can be similar, but they are placed in different structural places relative to each other and the other parts of the invention 10.

FIG. 7 shows a first ultrasonic transducer 49 of the calibrator 46 in the passage 50 for flow of drilling mud 24 through the tool body 16. FIG. 6 shows a first ultrasonic transducer 49 of the calibrator 46 for measuring in the passage 50 also. FIG. 4 shows a schematic view of a second ultrasonic transducer 52 of the calibrator 46 in the mud flow line 44 at the surface location 53. For example, FIG. 4 also shows the processor 61 in communication with both transducers 49. The data from the first and second transducers 49 and 52 can be processed so as to allow adjustment of data from the sensor 36 of the tool body 16. The calibration is important for increased accuracy and precision of the sensor means 36 of the present invention. The drilling mud 24 can affect the accuracy of readings of the sensor means 36 because so many particulates and density variations happen during active drilling; thus, MWD systems have a substantial error risk. The system 10 of the present invention reduces this error with the calibration means 46 for the sensor means 36 of the tool body 16.

In particular, the first ultrasonic transducer 49 is positioned in the passage 50 for flow with a fixed gap spacing slot 63 with a known diameter, transmitting a reading across the known diameter during drilling so as to record travel time across the known diameter. The readings of travel time across the known diameter and through the drilling mud 24 can be continuously monitored. If the reading for this known diameter through the mud flow changes, then the sensor 36 reading to the borehole wall should be calibrated according to this change. For example, the travel time is 60 μsec to travel across and back from a 2.0 inch gap in continuous monitoring mode. If the travel time increases to 65 μsec to travel the same distance, then there is interference from the drilling mud 24. The sensor means 36 should be calibrated so that the travel time for the unknown diameter distance from sensor to borehole wall is interpreted correctly. If the travel time for the unknown distance is 60 μsec, then the unknown distance is less than 2.0 inches because of the calibration adjustment from the first ultrasonic transducer 49.

The second ultrasonic transducer 49 can be a surface calibration block 52, as shown in FIG. 4, with known dimensions in the mud flow line 44, transmitting a reading across the calibration block. Different from the transducers 48 of the sensor means 36, but still similar to the first ultrasonic transducer 49, the calibration block 52 has a gate 65 with a fixed distance. The travel time for this fixed distance is monitored through the mud flow. If the readings of travel time for the fixed distance through the mud flow change, then the sensor 36 reading to the borehole wall should be similarly calibrated according to this change. The second ultrasonic transducer 49 as the calibration block 52 is a back-up calibration means and requires time adjustment for the readings and the timing of the mud flow 30 downhole and the mud flow 44 at the surface. So, the system 10 of the present invention can at least provide adjustments for drilling mud 24 based upon the surface location, as a backup for adjustments based on both the surface location and the downhole location, for the sensor means 36 at the downhole location.

Another embodiment of the system 10 of the present invention includes an auxiliary tool body 116 with a means for attachment 34 to the drill string 12 and an auxiliary sensor means 136 for detecting downhole conditions, such as borehole diameter. As shown in FIG. 3, the auxiliary tool body 116 is mounted between the underreaming means 14 and the bottom hole assembly 18 with the drill bit 20, and the auxiliary tool body 116 similarly has a diameter smaller than the underreaming means 14 and the drill bit 20. The auxiliary tool body 116 can have analogous features to the tool body 16, such that the auxiliary tool body 116 is virtually identical, except for placement in the drill string 12. Thus, FIG. 3 shows an auxiliary tool body 116 having an auxiliary sensor means 136 for detecting downhole conditions, a plurality of auxiliary stabilizer blades 138, and an auxiliary means for communicating 159 information from a downhole location to surface location. The maximum diameter of the stabilizer blades 138 on the auxiliary tool body 116 is still smaller than a diameter of the underreaming means 14 and the drill bit 20, and the stabilizer blades 138 are non-cutting protrusions aligned with the drill string 12. The auxiliary tool body 116 is another stabilizer positioned below the underreamer 14 on the side with the prior art LWD tools. FIG. 2B shows the placement of the auxiliary tool body 116.

The auxiliary tool body 116 further includes a corresponding auxiliary sensor means 136, which can be comprised of an ultrasonic transducer 148 with adjustable signal amplitude so as to measure diameter of the borehole. The auxiliary sensor means 136 can be comprised of piezo-electric material. The auxiliary sensor means 136 can also be fixed in position on the outer shell body 140 of the auxiliary tool body 116 or on the stabilizer blades 138. The corresponding downhole-surface communication means, inner housing, power supply, etc. are similarly housed in the auxiliary tool body 116. The readings of the auxiliary tool body 116 provide pilot borehole readings similar to the prior art. In combination with the features of the present invention, the system 10 provides even more accuracy and advance notice of irregularities for the underreamer 14. For example, the operation of the underreamer 14 can anticipate a slower or faster drilling rate based upon the readings of the auxiliary tool body 116, which detect diameter deviations possibly due to rock formation or mud variations. The auxiliary tool body 116 can also contribute readings for the calibration means 46 in monitoring drilling mud 24 variations.

The method for verification of a borehole, in particular for measuring a final diameter of a borehole, includes the step of drilling a pilot portion of the borehole 26 using a drill string 12 having a bottom hole assembly 18 with a drill bit 20 at a terminal end thereof and a circulation system 22 for drilling mud 24. The circulation system 22 flows drilling mud 24 through the drill string 12 and back up to a surface location. Next, the method includes drilling a reamed borehole 28 using an underreamer 14 attached to the drill string 12 above the drill bit 20. The underreamer 14 has a passage for flow of the drilling mud 24 and cutting edges 32 so as to enlarge a diameter of the pilot borehole to the reamed borehole. The method further includes measuring a diameter of the reamed borehole by a sensor 36 on a tool body 16 attached to the drill string 12 and mounted above the underreamer 14. Communicating real-time information from a downhole location to surface location is another step of the method of the present invention. Known downhole to surface telemetry sub, mud pulsar or wireless connection link to third party pulsar, or wired pipe transmit the sensor readings for use during drilling. The method of the present invention provides a more accurate final borehole verification because the measurement is taken after all cutting of the borehole has been completed, unlike the prior art LWD tools.

The method for verification of a borehole may also specifically incorporate measuring from an ultrasonic transducer, sometimes piezo-electric, with adjustable signal amplitude as the sensor 36, wherein the sensor 36 is fixed in position. This fixed position can be located on the outer shell body 40 or on said stabilizer blades 38. Sensors at any one of these locations can provide the data for the present invention. More than one location may have a sensor, so that more data is used to make the measurements even more precise. Each location has particular advantages. For example, the sensor placement on the stabilizer blades 38 increases accuracy of the reading because of proximity to the borehole wall and reduced drilling mud interference with the ultrasonic signal passing through the drilling mud. The transducers 48 of the sensor means 36 must be able to interact with the borehole wall in placement on the tool body 16 in order to take a measurement for verification.

Another step of the method of the present invention is calibrating the sensor 36 of the tool body 16 by a means for calibrating 46 comprised of transducers 49, on an interior 51 of the tool body 16 in fluid connection to the circulation system 22 of the drilling mud 24 through the drill string 12 and/or on a surface location 53 in fluid connection with the circulation system 22 of the drilling mud 24 in the mud flow line 44 at the surface. Thus, the means for calibrating 46 can include a first ultrasonic transducer 49 in the passage 50 for flow of the tool body 16 and a second ultrasonic transducer 49, which can be a calibration block 52, in the mud flow line 44 at the surface location. The passage 50 forms a flow path for the drilling mud 24 through the tool body 16. Data processed from the first and second transducers 49 and 52 allow adjustment of the data from the sensor 36 during drilling. The calibration corrects deviations caused by changes in drilling mud 24 properties, such that the final verification of the reamed borehole diameter is more precise and accurate. Specifically, the first ultrasonic transducer 49 is positioned in the passage for flow with a known diameter, transmitting a continuous reading across the known diameter during drilling so as to record travel time across the known diameter. Similarly, the second ultrasonic transducer 49 is a surface calibration block 52 with known dimensions placed in the mud flow line 44, transmitting a continuous reading across the calibration block. Any change in the continuous readings at either or both transducers 49 means that ultrasonic readings are being affected by changes in the drilling mud 24, such that the sensor 36 requires adjustment for a more accurate reading. Either transducer 49 can be used to adjust the readings of the transducers 48 of the sensor means 36, so the calibration block 52 can be a back up for the means for calibrating 46 downhole, that is, first transducer 49 in the passage 50, if there is a disruption in downhole communication means.

Still another step of the method for verification of a borehole includes attaching an auxiliary tool body 116 with an auxiliary sensor 136 to the drill string 12. The auxiliary sensor 136 detects downhole conditions, such as borehole diameter, as an LWD tool on the bottom hole assembly 18. The auxiliary tool body 116 is mounted between the underreamer 14 and the bottom hole assembly 18 with the drill bit 20, such that the auxiliary sensor 136 functions analogous to other prior art LWD tools, measuring the pilot borehole conditions. Similar to the tool body 16, measurement with the auxiliary tool body 116 includes the auxiliary tool body 116 having a diameter smaller than the underreamer 14 and drill bit 20 and a plurality of stabilizer blades 138. The auxiliary sensor 136 makes the same adjustments for fixed placement, such as on the stabilizer blades 138, communicates to the surface location, and is calibrated as the tool body 16. The auxiliary sensor means 136 may also contribute drilling mud 24 data for the calibration means 46. The additional sensor data provides additional precision and accuracy for analysis of the real-time data because the pilot borehole data is based upon actual real-time data, instead of the actual bit diameter of the drill bit. While drilling is proceeding, the real-time hole diameter signal information can be transmitted from down-hole, to the surface, by traditional methods i.e. telemetry sub (or mud pulsar or wireless connection link to third party pulsar), or through wired pipe (inteli-pipe), so as to provide real time hole diameter information, while drilling; named DBD (Drilling Bore-Hole Data). The method of the present invention constantly assesses the impact of wear on the drilling tools to prevent miscalculations that may cause inefficiency during the drilling process.

The system and method for verification of a borehole of the present invention improves the determination of the "final" diameter of a borehole, which is a borehole after drilling and after underreaming in real time. The present invention takes an actual measurement, which is more accurate than the measurements, which currently may use algorithmic calculations. The present invention has real-time capability, in addition to stored memory, so that adjustments in the drilling program can be made before excessive expenses are incurred. Also, the drilling operation does not have to stop in order to run a wireline mechanical caliper through the borehole for a hole diameter log. Furthermore, the system of the present invention is compatible with existing technology and can be applied to any expansion operation of a wellbore. It is conceivable that reamer technology may advance with cutting edges and adjustable diameters, and the present invention can be integrated in any version of an underreamer and bottom hole assembly.

The system and method for verification of a borehole with calibration means is another important innovation. A downhole and surface calibration block allows changes in the drilling fluid, which is flowing down through the drill string and up the annulus, to be monitored, and the travel-time (echo signal or attenuation) over an unknown distance (sensor to bore-hole wall) can be automatically corrected to allow for any changes in the drilling fluid (mud) properties, by using the downhole calibration sensor and/or the calibration block sensor at the surface to make corrections to the changes in attenuation or time of flight of the stand-off (gap between sensor and bore-hole wall) due to changes in the drilling mud. The placement of the tool body is also a stabilizer for the drill string itself as well. As a stabilizer, no actual drilling and reaming action is performed, which reduces risk of damage and disruption to the invention.

Another unique feature of this application, is that for comparison, the sensor and auxiliary sensor in the bottom hole assembly provide data from above and below reaming, thereby enabling a comparison between lower and upper signal readings. A longer travel time (echo signal), through the mud column in the annulus, with the ultrasonic sensor, would indicate that the reamed hole is larger than the pilot hole, which has been drilled with the smaller diameter drill bit and will have a faster travel time (echo signal) indicating a smaller gap between the sensor and the borehole wall.

Another advantage of the real time data of the present invention is that the system is dedicated to focusing on the final diameter of the borehole, and will be calibrated to the correct drilling mud properties. So, a more accurate reading of the annulus spacing between the sensors and the final (reamed) borehole wall will be achieved. The sensors will operate and emit a continuous signal, thereby recording hole diameter information continuously, i.e. while the BHA (Bottom Hole Assembly) is rotating and moving down (i.e. while drilling), or whether moving up or down (i.e. while off bottom or tripping), or stationary (i.e. while circulating).

The system provides more accuracy and precision before and after underreaming, which monitors how well the underreamer functions. To enable this greater accuracy, the auxiliary tool body with auxiliary sensor can be run below the reamer, in the pilot hole, which allows a comparison between the pilot hole ultrasonic signal below the reamer and the reamed hole ultrasonic signal in the larger diameter reamed hole. These ultrasonic signal readings will be tracked against time and drilled depth, for comparison, and the data will give indications of whether the reamer is cutting a correct gauge hole size, or whether the underreamer or reamer has failed to activate, so the 'pilot hole' and 'reamed hole' ultrasonic signals will be the same, showing that the borehole diameters are the same. The data may also show whether the underreaming means temporarily opened and then closed unexpectedly. As illustrated in FIG. 5, the 'pilot hole' ultrasonic signals 66 and 'reamed hole' ultrasonic signals 64 would initially start off reading different borehole diameters and would gradually or suddenly converge, indicating that the hole was not being reamed correctly. If the 'reamed hole' ultrasonic readings gradually began to converge with the 'pilot hole' readings, then it would indicate that the reamer was wearing and the hole was becoming 'tapered'.

As such, the system and method of the present invention provide a cost effective and efficient alternative to the prior art technology.

The foregoing disclosure and description of the invention is illustrative and explanatory thereof. Various changes in the details of the illustrated construction can be made without departing from the true spirit of the invention.

I claim:

1. A system for measuring borehole conditions, in particular for verification of a final diameter of a borehole, the system comprising:

a drill string having a bottom hole assembly with a drill bit at a terminal end thereof and a circulation means for drilling mud;

an underreamer attached to said drill string above said drill bit and having a passage for flow of said drilling mud, said underreamer being comprised of a reamer body and a plurality of reaming blades, said reaming blades having cutting surfaces so as to contact and ream walls of said borehole, enlarging said borehole after drilling by said drill bit; and a tool body being mounted above said underreamer and having a set diameter smaller than said underreamer so as to avoid contact with walls of said borehole and to maintain rigidity of said drill string, said tool body comprising:

an outer shell body with a means for detecting downhole conditions on an outer surface of said outer shell body;

an inner housing, having an exterior covered by said outer shell body, said outer shell body sliding over said exterior of said inner housing, said inner housing having an inner passage for flow of said drilling mud, said inner housing having a plurality of seals at opposite ends thereof in engagement with said outer shell body so as to form a sealed internal chamber on said exterior of said inner housing; and a means for attachment to said drill string on said outer shell body, wherein said tool body is rotatably and axially aligned with said drill string, said tool body being separate from said reamer body along said drill string, said flow of said drilling mud being along an outside of said outer shell body of said tool body and within the drill string through said inner housing of said tool body, wherein said circulation means for drilling mud has a mud flow line at a surface location, said system further comprising:

means for calibrating said means for detecting, said means for calibrating comprising:

a first ultrasonic transducer housed on said exterior of said inner housing for measuring within an interior of said tool body in fluid connection to said circulation system of said drilling mud through said drill string and a passage for flow of said tool body, the transducer being contained in said sealed internal chamber with an orientation to measure inward through said inner housing, the transducer being positioned on an end of said inner housing proximal to said means for detecting on said exterior of said outer shell body; and processing means for comparing data from the first transducer so as to allow adjustment of drilling, wherein said first ultrasonic transducer measures within said passage for flow with a fixed gap spacing slot with a known diameter, transmitting a reading across said known diameter toward said passage from said exterior of said inner housing during drilling so as to continuously record said reading across said known diameter for comparing drilling mud at said first ultrasonic transducer downhole to said drilling mud at said means for detecting; and wherein readings indicate need for an adjustment of readings of said means for detecting of said tool body.

2. The system for measuring borehole conditions, according to claim 1, wherein said tool body has a plurality of stabilizer blades, said stabilizer blades being fixed relative to said tool body, wherein a maximum diameter of said stabilizer blades on said tool body is smaller than a diameter of said reaming blades, said underreamer and said drill bit so as to avoid contacting said walls of said borehole and enlarging said borehole, wherein said stabilizer blades are non-cutting protrusions aligned with the drill string maintaining rigidity of said drill string, and wherein said maximum diameter of said stabilizer blades extends further from said tool body than said means for detecting so as to shield said means for detecting.

3. The system for measuring borehole conditions, according to claim 2, wherein said stabilizer blades are permanently extended from said tool body at said maximum diameter.

4. The system for measuring borehole conditions, according to claim 1, wherein said tool body has an application programming interface.

5. The system for measuring borehole conditions, according to claim 1, wherein said means for detecting is comprised of at least one ultrasonic transducer with adjustable signal amplitude so as to measure diameter of said borehole.

6. The system for measuring borehole conditions, according to claim 5, wherein the ultrasonic transducer is comprised of a piezo-electric material.

7. The system for measuring borehole conditions, according to claim 1, wherein said means for detecting has at least one fixed position, said fixed position being located on said outer shell body, said means for detecting being oriented to measure outward from said outer surface of said outer shell body.

8. The system for measuring borehole conditions, according to claim 7, wherein said inner housing contains a power supply means, circuitry, and memory storage means for sensor data.

9. The system for measuring borehole conditions, according to claim 1, further comprising:

means for communicating information from a downhole location to a surface location, said means for communicating being known downhole to surface telemetry sub, mud pulsar or wireless connection link to third party pulsar, or wired pipe.

10. The system for measuring borehole conditions, according to claim 1, wherein said circulation means for drilling mud has a mud flow line at a surface location, said system further comprising:

means for calibrating said means for detecting, said means for calibrating further comprising:

a second ultrasonic transducer on a surface location in fluid connection with said circulation system of said drilling mud, and in said mud flow line at said surface location; and processing means for comparing data from the second transducer so as to allow adjustment of drilling, wherein said second ultrasonic transducer is positioned at a surface location with a known diameter, transmitting a reading across said known diameter during drilling so as to continuously record said reading across said known diameter for comparing drilling mud at said second ultrasonic transducer at the surface location to said drilling mud at said means for detecting, and wherein readings indicate need for an adjustment of readings of said means for detecting of said tool body.

11. The system for measuring borehole conditions, according to claim 10, wherein said second transducer at the surface location is comprised of a surface calibration block with known dimensions in said mud flow line, transmitting a reading across the calibration block, having a gate with a fixed distance so as to continuously record travel time across said fixed distance for comparing drilling mud at said surface location to said drilling mud at said means for detecting at a downhole location.

12. A system for measuring borehole conditions, said system comprising:

a drill string having a bottom hole assembly with a drill bit at a terminal end thereof and a circulation means for drilling mud;

an underreamer attached to said drill string above said drill bit and having a passage for flow of said drilling mud, said underreamer being comprised of a reamer body and a plurality of reaming blades, said reaming blades having cutting surfaces so as to contact and ream walls of said borehole, enlarging said borehole after drilling by said drill bit;

a tool body being mounted above said underreamer and having a set diameter smaller than said underreamer so as to avoid contact with walls of said borehole and to maintain rigidity of said drill string, said tool body comprising:

an outer shell body with a means for detecting downhole conditions on an outer surface of said outer shell body;

an inner housing, having an exterior covered by said outer shell body, said outer shell body sliding over said exterior of said inner housing, said inner housing having an inner passage for flow of said drilling mud, said inner housing having a plurality of seals at opposite ends thereof in engagement with said outer shell body so as to form a sealed internal chamber on said exterior of said inner housing; and a means for attachment to said drill string on said outer shell body, wherein said tool body is rotatably and axially aligned with said drill string, said tool body being separate from said reamer body along said drill string, said flow of said drilling mud being along an outside of said outer shell body of said tool body and within the drill string through said inner housing of said tool body; and an auxiliary tool body being mounted between said underreamer and said drill bit, said auxiliary tool body having a set diameter smaller than said underreamer so as to avoid contacting with walls of said borehole and to maintain rigidity of said drill string, said tool body being located on an opposite side of said underreamer than said auxiliary tool body, wherein said auxiliary tool body comprises:

an auxiliary outer shell body with a means for detecting downhole conditions on an outer surface of said auxiliary outer shell body;

an auxiliary inner housing, having an exterior covered by said auxiliary outer shell body, said outer shell body sliding over said exterior of said inner housing, said auxiliary inner housing having an auxiliary inner passage for flow of said drilling mud, said auxiliary inner housing having a plurality of auxiliary seals at opposite ends thereof in engagement with said auxiliary outer shell body so as to form an auxiliary sealed internal chamber on said exterior of said auxiliary inner housing; and an auxiliary means for attachment to said drill string on said outer surface of said outer shell body, wherein said auxiliary tool body is rotatably and axially aligned with said drill string, said auxiliary tool body being separate from said reamer body and said tool body along said drill string, said flow of said drilling mud being along an outside of said auxiliary outer shell body of said auxiliary tool body and within the drill string through said auxiliary inner housing of said auxiliary tool body, and wherein said auxiliary tool body further comprises an auxiliary means for attachment to said drill string, an auxiliary means for detecting downhole conditions, and an auxiliary means for communicating information from a downhole location to said surface location, said auxiliary means for communicating being known downhole to surface telemetry sub, mud pulsar or wireless connection link to third party pulsar, or wired pipe.

13. The system for measuring borehole conditions, according to claim 12, wherein said auxiliary tool body is comprised of a plurality of auxiliary stabilizer blades, wherein a maximum diameter of said auxiliary stabilizer blades on said auxiliary tool body is smaller than a diameter of said reaming blades, said underreamer and drill bit so as to avoid contacting said walls of said borehole and enlarging said borehole, wherein said auxiliary stabilizer blades are non-cutting protrusions aligned with the drill string, said auxiliary stabilizer blades being fixed relative to said auxiliary tool body, and wherein said maximum diameter of said auxiliary stabilizer blades extends further from said tool body than said means for detecting so as to shield said means for detecting, and wherein said auxiliary means for detecting is comprised of an ultrasonic transducer with adjustable signal amplitude so as to measure diameter of said borehole.

14. The system for measuring borehole conditions, according to claim 12, wherein said circulation means for drilling mud has a mud flow line at a surface location, said system further comprising:

means for calibrating said means for detecting, said means for calibrating comprising:

a first ultrasonic transducer housed on said exterior of said inner housing for measuring within an interior of said tool body in fluid connection to said circulation system of said drilling mud through said drill string and a passage for flow of said tool body, the transducer being contained in said sealed internal chamber with an orientation to measure inward through said inner housing, the transducer being positioned on an end of said inner housing proximal to said means for detecting on said exterior of said outer shell body; and said auxiliary means for detecting of said auxiliary tool body.

15. A method for measuring a borehole, in particular for measuring a final diameter of a borehole, the method comprising the steps of:

drilling a pilot borehole using a drill string having a bottom hole assembly with a drill bit at a terminal end thereof and a circulation system for drilling mud, said circulation system flowing drilling mud through said drill string and to a surface location;

reaming said pilot borehole with an underreamer, wherein said underreamer is attached to said drill string above said drill bit and has a passage for flow of said drilling mud, said underreamer being comprised a reamer body and a plurality of reaming blades, said reaming blades having cutting edges so as to enlarge a diameter of said pilot borehole to a reamed borehole;

measuring a diameter of the reamed borehole by a sensor on a tool body attached to said drill string and mounted above said underreamer, said tool body having a means for attachment to said drill string, said tool body being separate from said underreamer along said drill string, said tool body having a set diameter smaller than said underreamer so as to avoid contact with walls of said borehole and to maintain rigidity of said drill string, said tool body being comprised of an outer shell body and an inner housing;

attaching an auxiliary tool body with an auxiliary sensor to said drill string below said underreamer, being between said underreamer and said bottom hole assembly;

measuring a diameter of said borehole between said underreamer and said drill bit with said auxiliary sensor, said auxiliary tool body having a set diameter smaller than said underreamer and said drill bit so as to avoid contact with walls of said borehole and to maintain rigidity of said drill string;

comparing measurements from said tool body and said auxiliary tool body in real-time during the step of drilling the pilot hole and the step of reaming the borehole so as to assess said underreamer separate from said drill bit and said underreamer together with said drill bit;

communicating real-time information from a downhole location to surface location, using known downhole to surface telemetry sub, mud pulsar or wireless connection link to third party pulsar, or wired pipe.

16. The method for measuring a borehole, according to claim 15, the method further comprises the step of:

calibrating said sensor of tool body by said auxiliary sensor of said auxiliary tool body; and processing data from said auxiliary sensor and said sensor on said tool body so as to allow adjustment of drilling.

17. The method for measuring a borehole, according to claim 15, said outer shell body covering an exterior of said inner housing, said inner housing having an inner passage for flow of said drilling mud, said inner housing having a plurality of seals at opposite ends thereof in engagement with said outer shell body so as to form a sealed internal chamber on said exterior of said inner housing, the method further comprises the step of:

calibrating said sensor of said tool body by a first ultrasonic transducer in an exterior of said inner housing measuring with said passage for flow of said tool body from said sealed internal chamber, wherein said first ultrasonic transducer measures said passage for flow with a fixed gap spacing slot with a known diameter from said exterior of said inner housing, transmitting a reading across said known diameter across a portion of said inner housing and said passage during drilling so as to continuously record readings across said known diameter, comparing drilling mud at said first ultrasonic transducer downhole to said drilling mud at said sensor, wherein readings indicate need for an adjustment of readings of said sensor of said tool body.

18. The method for measuring a borehole, according to claim 17, further comprising the step of:

calibrating said sensor of said tool body by a second ultrasonic transducer in said mud flow line at said surface location, wherein said second ultrasonic transducer is a surface calibration block with known dimensions in said mud flow line, transmitting a reading across the calibration block, having a gate with a fixed distance so as to continuously record readings across said fixed distance, comparing drilling mud at said surface location to said drilling mud at said sensor of said tool body downhole, wherein readings indicate need for an adjustment of readings of said sensor of said tool body; and processing data from the second transducer so as to allow adjustment of drilling.

19. The method for measuring a borehole, according to claim 15, said outer shell body covering an exterior of said inner housing, said inner housing having an inner passage for flow of said drilling mud, said inner housing having a plurality of seals at opposite ends thereof in engagement with said outer shell body so as to form a sealed internal chamber on said exterior of said inner housing, the method further comprising the step of:

calibrating said sensor on an outer surface of said outer shell body of said tool body by a first ultrasonic transducer in said sealed internal chamber on said exterior of said inner housing measuring within said passage for flow of said tool body; and calibrating an auxiliary sensor on an outer surface of an auxiliary outer shell body of said auxiliary tool body by an auxiliary first ultrasonic transducer in an auxiliary sealed internal chamber on an exterior of an auxiliary inner housing of said auxiliary tool body, said auxiliary first ultrasonic transducer being within range of an auxiliary passage for flow of said auxiliary tool body; and processing data from said auxiliary first ultrasonic transducer so as to allow adjustment of drilling.

* * * * *